350-96.3 SR

8/15/78 XR 4,106,231

NO SUB CLASS

United States Patent [19]

MacNiel

[11] 4,106,231

[45] Aug. 15, 1978

[54] LOW LEVEL LIGHT INDICATOR

[75] Inventor: Douglas K. MacNiel, Costa Mesa, Calif.

[73] Assignee: Master Specialties Company, Costa Mesa, Calif.

[21] Appl. No.: 747,613

[22] Filed: Dec. 6, 1976

[51] Int. Cl.[2] ..... G09F 13/18

[52] U.S. Cl. ..... 40/547; 40/452; 340/380; 350/96.30

[58] Field of Search ..... 40/130 K, 130 E, 28 C, 40/132 R, 130 R; 340/380, 336, 378; 350/96 R, 96 B, 96 BC, 96 BR, 188; 240/1 LP, 1 EL, 41.19

[56] References Cited

U.S. PATENT DOCUMENTS

| | | | |
|---|---|---|---|
| 2,843,002 | 7/1958 | Allison | 40/130 K X |
| 3,210,876 | 10/1965 | Towne | 40/130 E |
| 3,545,114 | 8/1970 | Hurst et al. | 40/130 E |
| 3,562,746 | 2/1971 | Aron | 350/96 B X |
| 3,631,478 | 12/1971 | McNaney | 340/380 |
| 3,739,512 | 6/1973 | Ruppert | 40/130 E X |
| 3,768,188 | 10/1973 | Kurtenbach et al. | 40/130 E |

*Primary Examiner*—John F. Pitrelli

*Attorney, Agent, or Firm*—George F. Bethel; Patience K. Bethel

[57] ABSTRACT

The following specification discloses a low level lighting indicator readout or display of the type having a lighting source such as incandescent lamps that have been placed in a heat sink. The incandescent bulbs or lamps are connected to a logic network, so that one or a plurality of bulbs can be lit by the logic network in order to cause a particular display to be registered. The display is registered by means of the lamps passing light through a series of conductive light tubes such as fiber optic members that emanate therefrom to form a series of optical readouts in the form of dots, or segments, such as bar displays. The termination of the light pipes provide a matrix in the form of a dot pattern that can be driven to create various displays in the form of alpha numeric representations or other symbols. A specialized diffuser comprising this invention having miniaturized particles or spherical glass beads on the surface thereof at the interface between the lamps and the light pipes, allows for a transmission of light therethrough at low level voltages on the lamps.

11 Claims, 6 Drawing Figures

LOW LEVEL LIGHT INDICATOR

BACKGROUND OF THE INVENTION

1. Field of the Invention

The field of this invention lies within the art of lighted displays, indicators and readouts. More particularly, it lies within the fiber optic or light pipe readout art wherein an incandescent bulb is utilized to transmit light on a logically designated basis through a plurality of light pipes or fiber optic elements to create a desired display within such areas as industrial and aircraft displays.

2. The Prior Art

The prior art related to readouts and indicators for displays used in aircraft, industrial panels and general readouts often incorporates incandescent lighting or light emitting diodes. When incandescent lamps are utilized, it is oftentimes in conjunction with certain fiber optic or light pipe combinations. In particular, a lamp or plurality of lamps will be utilized with respect to a number of fiber optic or light pipe elements that terminate on the face of the readout or display. This is particularly common in aircraft fiber optic readouts.

In such fiber optic readouts, the incandescent lamp or light source and the fiber optic light pipe transmit the light directly to the display face to provide the net result of a minimal amount of lost light. The displays are created by lighting various combinations of lamps connected to the dot patterns or readouts at their terminal points by virtue of the connectors of the lamp being connected to a particular logic network. In this manner, improved standards of legibility and brightness for such displays as avionic displays, and other control panels, whether they be industrial or otherwise, are created. The end result is to create displays readable in extremes of ambient lighting conditions.

The readouts generally have a heat sink in order to drain the heat generated by the incandescent lamps. By draining the heat through a heat sink, the net result is to create a situation wherein the lamp can be lit from high voltages to low voltages, depending upon the amount of lighting output that is required.

The lamps are interfaced with their fiber optical tubes or light pipes which terminate at the surface which provides the readout. This surface is exposed to ambient lighting, and as a consequence, both the light created by the incandescent lamps and the ambient lighting must be balanced and often conflict with each other in order to create a proper display.

One of the main problems of the prior art is that when a very low level lighting condition is to be utilized, the incandescent filaments do not provide the uniformity of coverage and light output. This is particularly serious in low level lighting conditions where a particular output is required at a low level, and it must be uniform.

A second problem is that the diffusers of the prior art allow for an introduction of ambient light into the light pipes which then allows the light to scatter and be displayed in a spurious manner, so that the appearance of a false readout or display is provided. In other words, the outside lighting is reflected backwardly after it passes into the display through the light pipes and creates a spurious reading of the given display, thereby causing confusion.

This invention overcomes the foregoing two deficiencies of low voltage level lighting problems and spurious displays. The diffuser and its characteristics allow for ambient light to be absorbed and readily diffused to prevent spurious lighting displays on the face of the display. The diffuser of this invention thereby serves the multi purpose of providing proper low level lighting at low voltages, while at the same time preventing ambient light from causing spurious readings.

SUMMARY OF THE INVENTION

In summation, this invention provides a fiber optic readout that is immune to spurious displays on the face thereof due to ambient lighting, as well as providing uniform low level voltage lighting displays.

More particularly, the invention incorporates the utilization of incandescent bulbs within a heat sink which is connected and interfaced to a fiber optic body having a display on the face thereof. The filaments of the lamps within the heat sink are spaced from the introductory point of the fiber optic elements or the light tubes by a diffuser film. The diffuser film is a relatively thin plastic that is generally not in excess of 10 mils in thickness. On the face of the thin film of the diffuser are a plurality of glass particles, plastic chips, or relatively spherical glass beads that are directly interfaced with the entrance to the light pipes.

In the foregoing structure, the light which is reflected inwardly from ambient lighting sources is diffused over a broad range. Thus, the light cannot create a spurious lighting effect on the face of the display by reflecting backwardly through the fiber optic element. This is due to absorption within the multi surfaced glass particles. At the same time, low voltages on the incandescent lamps will still allow sufficient lighting of the light pipes by virtue of the fact that the light is sufficiently diffused from the filaments of the lamps to allow for proper passage in a clear manner. In other words, at the lower voltage ranges there is sufficient light by diffusion for distribution over the area served by the light pipe related thereto.

DESCRIPTION OF THE DRAWING FIGURES

The invention will be more clearly understood by reference to the description below taken in conjunction with the accompanying drawings wherein.

DESCRIPTION OF THE PREFERRED EMBODIMENTS

Figure 3:
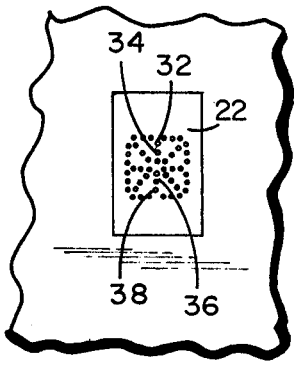
FIG. 3 shows a front elevation view of the readout of this device as seen from the left side of FIG. 1.
Figure 1:
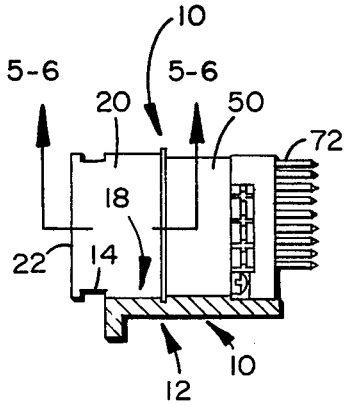
FIG. 1 shows a side elevation view of the readout of this device mounted within a sectioned panel.
Figure 2:
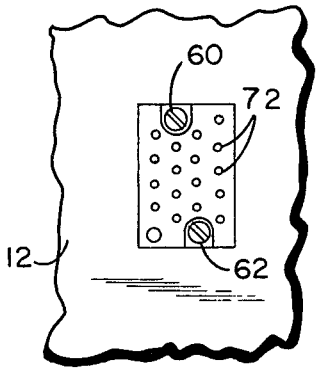
FIG. 2 shows a rear elevation view of the readout of this device looking at the pins from the ends thereof.

FIG. 1 shows an example of an indicator light readout or display 10 which can be designed with the elements of this invention. The readout 10 is mounted within a housing 12 and has a groove or recess 14 for removal of the readout. The recess 14 can be implaced in the readout body completely around its body, or it can be on only two sides as shown in the specific embodiment.

A top portion of the readout 18 is generally referred to as the lens assembly and incorporates a plastic body 20 having a face 22 thereon. The face 22 receives a plurality of light pipes or fiber optic elements such as elements 24, 26, 28 and 30. The light pipes terminate in respective dots at their ends, namely dots 32, 34, 36 and 38 forming a pattern to provide an alpha numeric display. The dot pattern exemplified by the dots are terminal points of the fibers 24 through 30 that provide the fiber optics of this device. The plastic block 20 can be cast of any particular material around the elements.

The dots 32 through 38 can be substituted by having a number of plastic terminal surfaces at the faces thereof which form different displays, such as a bar display or other segments of the various showings. The dot pattern can also be pre-established so that any particular showing of an alpha numeric symbol can be utilized or a plurality of different showings can be utilized, depending upon which lights are energized to provide the dot pattern.

In addition to the fiber optic elements 24 through 30, light pipes, such as plastic tubes or plastic blocks can be utilized to provide the passage of light from the lamps. Thus, the invention has broad use with regard to any incandescent or LED light emissions, whether they be combined with a fiber optic element or a light tube or plastic molded bar.

Looking more particularly at the readout 10, it can be seen that a heat sink 50 is shown having a number of openings 52 therein. The heat sink can be of a metallic material, such as aluminum having a degree of thermal conductivity. The openings 52 correspond to a plurality of the interfacing portions of the fiber optic elements or light tubes 24 through 30. Each opening 52 receives an incandescent lamp 54 having a base 56 and a bulb portion 58. The heat sink 50 is affixed to the base 64. The terminal base 64 with the screws 60 and 62 attached to the heat sink maintain the incandescent bulbs in fixed relationship within the heat sink.

A plurality of plastic spacers or insulators 68 surround each one of the bases of the incandescent lamps 54 and at the same time provide a place for the lamps to be secured and received therein. Projecting from the back of each lamp are lamp contact prongs 72. The lamp contact prongs allow the lamps to be secured to their respective female contacts that receive the prongs. Each prong is associated with a particular electrical output that has been coordinated or provided in a matrix or logic network for driving each respective lamp or plurality therof. In other words, the logic network for driving the pins 72 is analogous to the logic required for creating a particular display on the readout surface formed from the dots or analogous bar segments or terminal portions of the light pipes at the surface 22 of the readout.

One of the unique portions of this invention is provided by the diffuser 90. The diffuser 90 is formed of a thin sheet of plastic 92 generally in the neighborhood of 1 to 10 mils.

Figure 5:
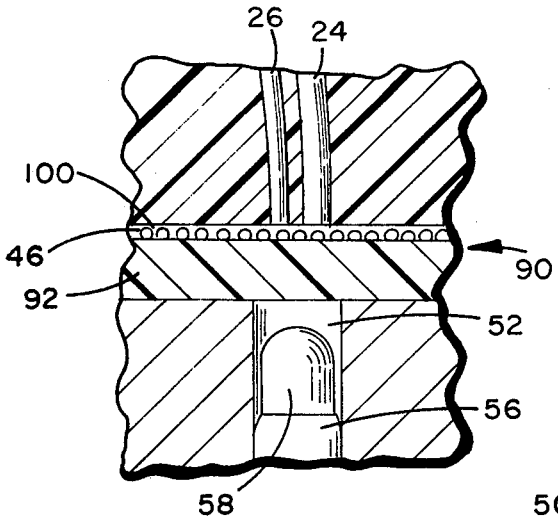
FIG. 5 shows a sectional view of this invention looking in the direction of lines 5–6 of FIG. 1.
Figure 6:
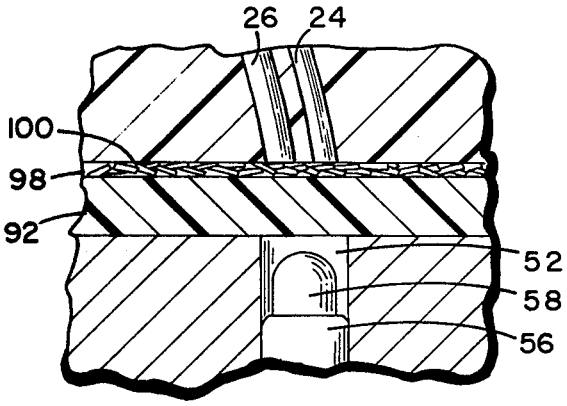
FIG. 6 shows a second alternative embodiment looking in the direction of lines 5–6 of FIG. 1 wherein a different type of diffuser is shown.
Figure 4:
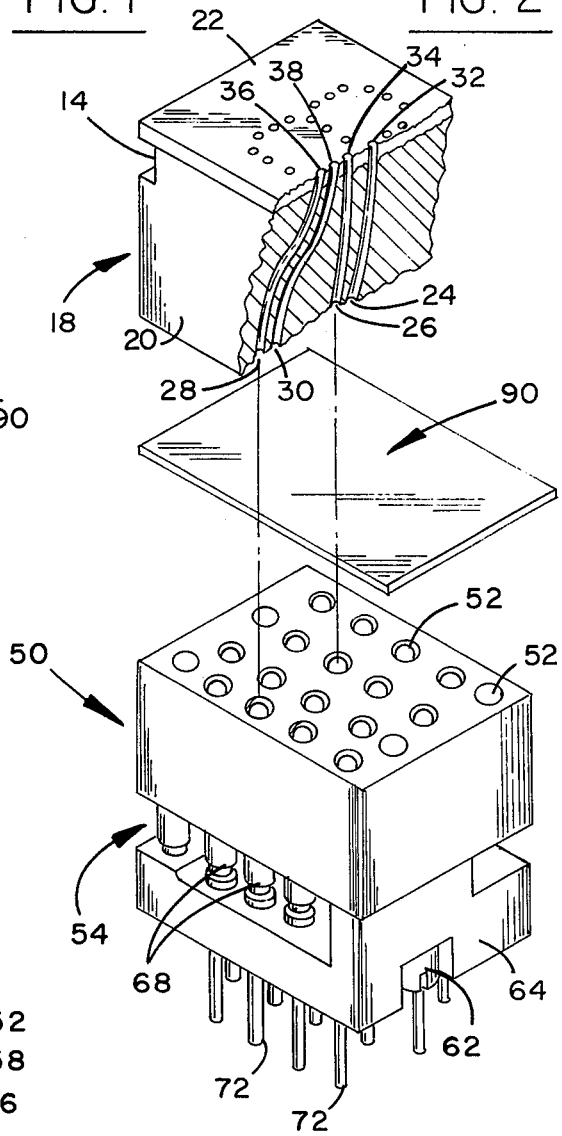
FIG. 4 shows an exploded partially sectioned and fragmented view of the readout of this invention with the various parts thereof in displaced relationship from each other, wherein the diffuser of this invention is sandwiched between the fiber optic elements of this invention and the lamps.

The diffuser 90 which incorporates the plastic substrate or sheet 92, has a plurality of glass particles, such as beads, or in the alternative, glass chips. FIG. 5 shows a number of glass beads 96, while FIG. 6 shows a number of glass chips 98. The plastic film 92 or sheet is a polycoat type of diffusing surface. In particular, the glass beads 96 or chips 98 are held in situ on the film 92 by means of a plastic sealer 100 that forms a matrix over and partially between the glass beads or chips. Thus, the diffuser is formed from the plastic sheet 92 and plastic matrix 100 bearing the respective spheres 96 or chips 98.

Other particles can be substituted for the glass chips or spheres respectively 98 and 96. For instance, plastic chips or other transparent or translucent materials can be utilized.

In operation, the diffuser 90 functions to prevent any ambient lighting at the face 22, which passes into the openings or dots 32 through 38, to be reflected backwardly through the light pipes 24 through 30. It thereby prevents backlighting from the interior reflective surfaces such as those provided by the bulb 58, heat sink 50, or for that matter, the diffuser itself. Thus, the light entering the light tubes such as tubes 24 and 26, which is cast on the variegated surfaced particles or multiplicity of chips, spheres, or other discrete materials, is absorbed therein.

Also, due to the relative thinness of the diffuser 90, the passage of light from one lamp bulb or from reflected ambient light laterally through the diffuser 98 to another area is eliminated. Thus, light is not transmitted to and up an adjacent light pipe. In other words, reflected light or light provided by a lamp serving tubes 24 and 26 is not transmitted to tubes 28 and 30. This is due to the relative thinness of the diffuser and the fact that the diffuser cannot serve as a light conductor, yet at the same time provides a diffuser.

In addition to the foregoing features, when the lamp 58 is at a very low voltage, such as in dim or low level lighting conditions within an aircraft for night operation, the diffuser provides a sufficient spread of the light in an even pattern across the entry to the light pipes or fiber optic elements 24 through 30 without attendant transmittal of the light to an adjacent area.

To provide the foregoing effects, it is felt that the diffuser 90 should be relatively thin, within the ranges of 1 to 10 mils thickness, or as thin as possible while at the same time providing the different particles on the surface thereof in the plastic matrix. Furthermore, any glass, plastic, or other multiplicity of particles providing a number of variegated surfaces, can be utilized. Any particular plastic matrix holding the multiplicity of elements on the film can be utilized. Also, the thickness of the particles 96 and 98 can range from one layer to successive layers, depending upon the degree of light diffusion and absorption required. The main requirement is that the multi surfaced chips or spheres can be of a nature that they reflect and absorb the light rays on a multitudinous basis respectively between them.

As a consequence of the foregoing, this invention should have broad application within the light diffusing and absorbing art in all types of readouts wherein light is transmitted from a light source through a light pipe and displayed at the end thereof. Thus, this invention is to be read broadly over the prior art with regard to light tubes and light transmission devices or readouts, in the full scope and spirit of the following claims.

I claim:

1. The improvement in a readout having a light source therein and means for conducting said light from said source to a display surface comprising:

a source of light comprising a plurality of incandescent lamps;

means for holding said source of light; means for connecting said incandescent bulbs to a power source;

a plurality of narrow elongated solid light pipes in proximate relationship to said light source that serve to receive light from said light source;

a relatively thin diffuser film between said source of light and said light pipes comprising a substrate of translucent material to permit the passage of light from said light source therethrough while at the same time modulating the light by diffusion;

a matrix cast around said light pipes for holding said light pipes; and, a surface at which said light pipes terminate to provide a display in the form of the terminal portions of said light pipes at said surface.

2. The improved readout as claimed in claim 1 further comprising:

a heat sink for said incandescent lamps.

3. The improved readout as claimed in claim 1 wherein:

said light pipes comprise solid plastic elements.

4. The improved readout as claimed in claim 3 further comprising:

a means for mounting said readout within a panel.

5. The improved readout as claimed in claim 1 wherein:

said diffuser film comprises a plastic film with glass particles on the surface thereof held in a plastic matrix on the surface of said film.

6. An improved readout for providing a display on the face thereof having a light pattern of a predesignated symbol which can be designated on a fixed basis or provided by a logic network comprising:

a plurality of incandescent bulbs;

a heat sink for said incandescent bulbs;

means for connecting said incandescent bulbs to a power source;

a plurality of light pipes in proximate relationship to said incandescent bulbs for receiving the light from said incandescent bulbs;

a mounting means cast around said light pipes for holding said light pipes;

a surface on said mounting means for terminating said light pipes; and, a diffuser directly interfacing said incandescent lamps and said light pipes wherein said diffuser comprises a plastic film.

7. The improved readout as claimed in claim 6 wherein said light pipes comprise:

fiber optical elements.

8. The improved light or readout as claimed in claim 7 further comprising:

a base for mounting said incandescent lamps in said heat sink which is attached to said heat sink; and, terminals extending from said incandescent lamps adapted for connection to the means for providing power to said incandescent lamps.

9. The improved readout as claimed in claim 8 further comprising:

mounting means for holding said improved readout within a panel.

10. The improved readout as claimed in claim 8 wherein:

said terminals consist of a plurality of pins depending from said incandescent bulb mounting base.

11. The improved readout as claimed in claim 9 wherein said heat sink comprises:

a metallic material having a plurality of openings into which said incandescent bulbs are placed.

* * * * *